United States Patent [19]

Wendel et al.

[11] Patent Number: 5,005,545

[45] Date of Patent: Apr. 9, 1991

[54] FLOW REGULATOR

[75] Inventors: Friedrich Wendel, Weissach; Dieter Dick, Muehlacker, both of Fed. Rep. of Germany

[73] Assignee: Robert Bosch GmbH, Stuttgart, Fed. Rep. of Germany

[21] Appl. No.: 452,669

[22] Filed: Dec. 19, 1989

[30] Foreign Application Priority Data

Feb. 24, 1989 [DE] Fed. Rep. of Germany ..... 3905655

[51] Int. Cl.[5] ..... F02D 9/08

[52] U.S. Cl. ..... 123/337; 123/339; 123/585; 137/454.2

[58] Field of Search ..... 123/337, 339, 585; 251/305, 309; 137/454.2

[56] References Cited

U.S. PATENT DOCUMENTS

| | | | |
|---|---|---|---|
| 3,206,163 | 9/1965 | Freed | 251/309 |
| 3,916,943 | 11/1975 | Hester et al. | 251/309 |
| 4,339,110 | 7/1982 | Ortega | 251/309 |
| 4,388,373 | 6/1983 | Grimm et al. | 123/339 |
| 4,428,356 | 1/1984 | Kemmner | 123/339 |
| 4,478,388 | 10/1984 | George | 251/309 |
| 4,494,517 | 1/1985 | Kratt et al. | 123/339 |
| 4,494,730 | 1/1985 | George | 251/309 |
| 4,606,368 | 8/1986 | McCafferty | 137/454.2 |

FOREIGN PATENT DOCUMENTS

| | | | |
|---|---|---|---|
| 3313830 | 11/1984 | Fed. Rep. of Germany | 123/339 |
| 0182435 | 8/1986 | Japan | 123/339 |
| 1602507 | 11/1981 | United Kingdom . | |

*Primary Examiner*—Tony M. Argenbright
*Assistant Examiner*—Robert E. Mates
*Attorney, Agent, or Firm*—Edwin E. Greigg

[57] ABSTRACT

The regulator of this invention is used specifically to regulate the idling speed of an internal combustion engine and includes a servomotor, a throttle unit and a holder designed as separate units and are intended to be combined in an appropriate manner for a particular application. Thus, the throttle unit is provided with a throttle housing incorporating in a cylindrical housing part, a turning space for a throttle member which is connected to a flow channel via an inlet opening and an outlet opening. The flow channel is, for example, built into a wall of an air intake pipe of an internal combustion engine and intersects a receiving opening of this air intake line serving as the holder. The throttle unit is insertable in the receiving opening and is used to control the magnitude of the airflow.

21 Claims, 2 Drawing Sheets

Fig. 4
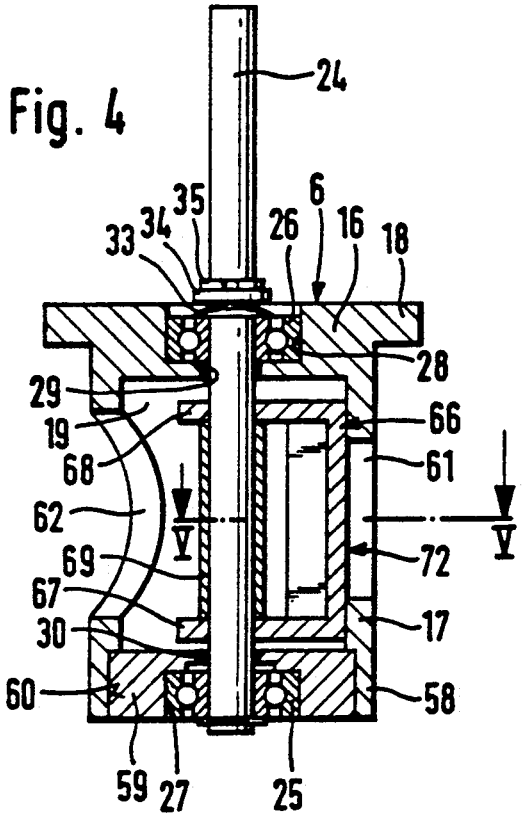
Fig. 7
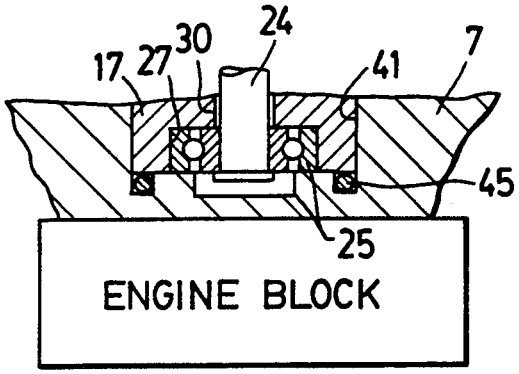
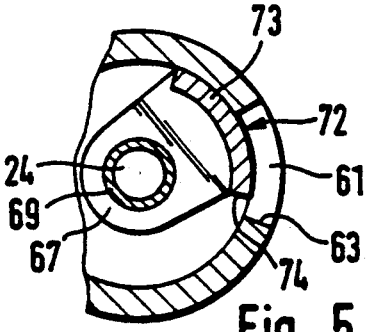
Fig. 5
Fig. 6
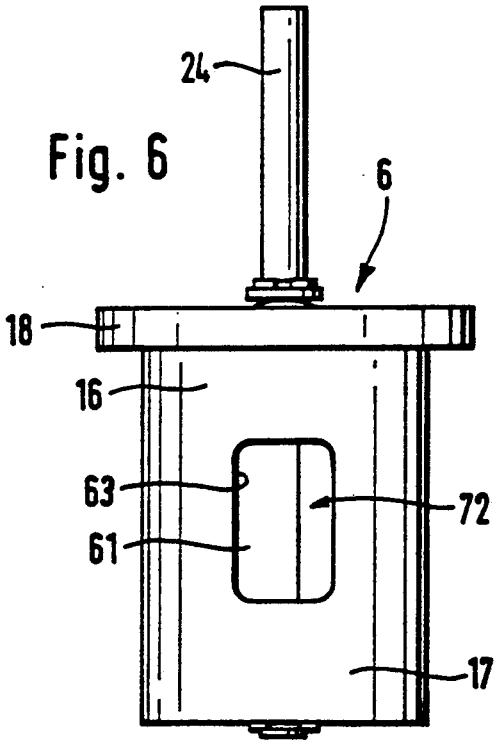

FLOW REGULATOR

BACKGROUND OF THE INVENTION

The invention relates to a regulator as set forth herein. A regulator is already known as set forth in U.S. Pat. No. 4,388,913, wherein a shaft with a throttle member is mounted in a cover connected to a servomotor and inflow and outflow connection pieces for the medium to be controlled are formed on the cover. A disadvantage of this arrangement is that during assembly of the regulator, it is necessary to determine in advance the disposition of the inflow and outflow connection pieces with respect to one another, more particularly whether they should be in alignment with one another, parallel to one another, at right angles to one another or in some other arrangement. These types of regulators are used to control the idling speed of an internal combustion engine and, accordingly, it is advantageous that they should be readily interchangeable and that they can be mounted in narrow places in the engine of the vehicle. It is also advantageous to be able to change the disposition of the inflow and outflow connection pieces.

OBJECT AND SUMMARY OF THE INVENTION

An advantage of a regulator according to the invention having the features described is that while using only a single throttle unit it is possible to produce in a simple manner regulators which can be incorporated directly in the wall of an air intake line or engine block of an internal combustion engine or, if connection pieces are needed, which allow the positions of the connection pieces to be changed with respect to one another. It is advantageous for the housing part to be insertable in a desired 10 manner in a receiving orifice of an appropriate holder. The holder can include a ,readily interchangeable independent part provided with differing connector arrangements or it may include for example, a wall of an air intake line or of an engine block of an internal combustion engine. In this way, the preassembled throttle unit can be completed as desired by combining it with the requisite holder provided with the appropriate connectors. Alternatively, the holder can be replaced by another holder having connectors which run in a different direction or the throttle unit can be readily inserted in the wall of the air intake line of an internal combustion engine or in the engine block for the purpose of controlling the flow of a medium in a flow channel provided in the latter. By designing a single throttle unit which can be used in a plurality of regulating devices having different configurations, a significant cost reduction can be obtained in view of the large quantity of these products.

The measures described herein represent advantageous developments of and improvements to the regulating device described.

In addition to mounting the throttle unit in a receiving orifice in the wall of the air intake line or engine block of an internal combustion engine, it is advantageous to mount the throttle unit in an independent holder provided with an inflow connector and an outflow connector each incorporating flow sections of the flow channel and extending in different directions to one another, for example, they may be in alignment with one another, parallel to one another, at an angle to one another, etc.

It is also advantageous for the throttle member to be in the form of a throttle valve or rotary slide valve having an attachment part connected to the shaft and a control part, more particularly, an annular control part. In this way, accurate controlling of the flow of medium with minimum unwanted air leakage at the throttle member can be achieved.

It is especially advantageous to provide a control window in the wall of the cylindrical housing part of the throttle housing. The control window can be opened to the required extent by the control part of the rotary slide valve and its cross-sectional dimension can be readily designed to ensure that the maximum quantity of the medium flows through the flow channel when the cross-section is fully opened by the control part.

The advantage of providing the control window with a generally rectangular shape is that with a control edge of the control part extending parallel to a lateral face of the control window, a linear connection between the angle of rotation of the rotary slide valve and the opened cross-section of the control window is obtained.

It is also advantageous to provide the throttle housing with a flange which can be placed on the holder and attached thereto and on which a servomotor acting on the shaft of the throttle unit can also be attached.

It is especially advantageous to use the throttle unit according to the invention to control the air flow in a by-pass line around a throttle valve mounted in an air intake line of an internal combustion engine.

BRIEF DESCRIPTION OF THE DRAWINGS

The drawings show simplified embodiments of the invention which will be described in greater detail hereinafter.

FIG. 4 shows a section through a throttle unit comprising a rotary slide valve;

FIG. 5 shows a section along the line V—V in FIG. 4;

FIG. 6 shows a side view of a throttle unit as shown in FIG. 4; and

FIG. 7 illustrates a throttle unit holder secured onto an engine block.

DESCRIPTION OF THE PREFERRED EMBODIMENTS

Figure 1:
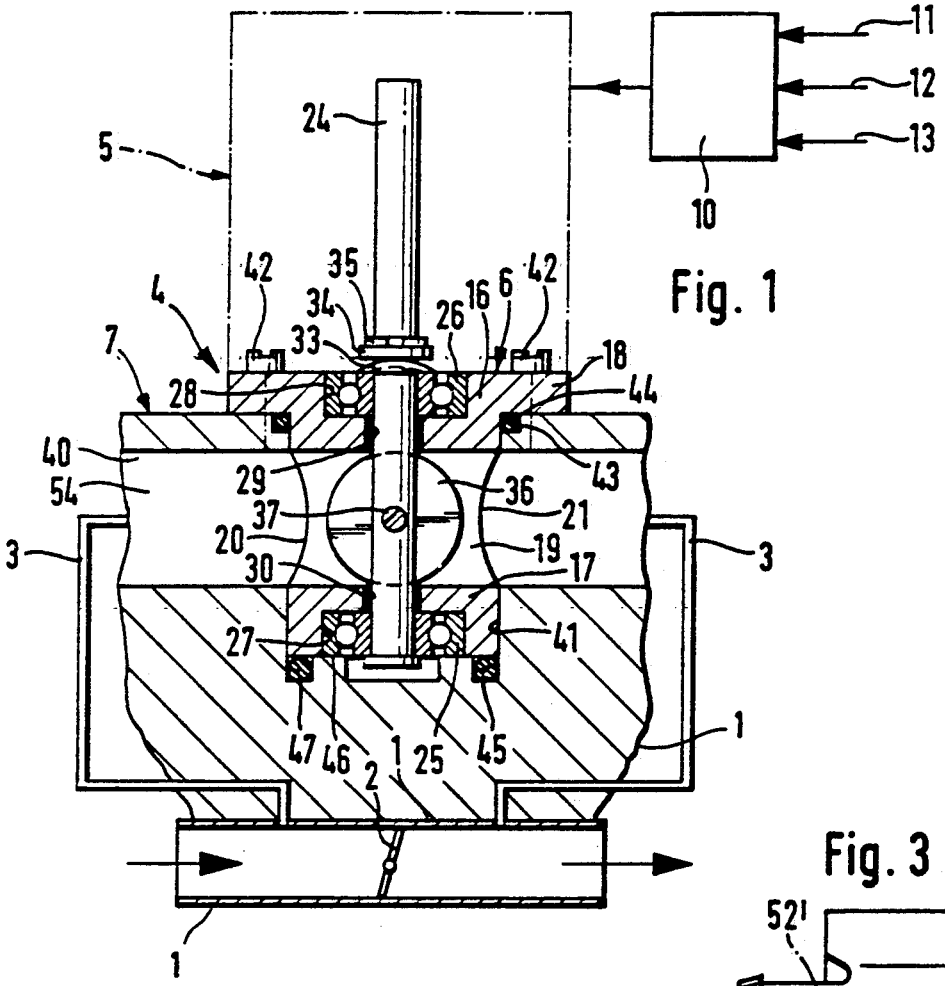
FIG. 1 shows a cross sectional view of a first embodiment of a regulator according to the invention.

In FIG. 1, combustion air flows through an air intake line 1 past a throttle valve 2 to an internal combustion engine (not shown). Connected to the air intake line 1 is a by-pass line 3 which leads around the throttle valve 2 and in which the flowing air is controlled by a regulating device 4. The regulating device 4 comprises a servomotor 5 indicated by the perforated lines, a throttle unit 6 and a holder 7.

The servomotor 5 is of a known design, for example, as described in German patent 28 12 292 or British patent 16 12 507 or German disclosure document 30 01 473 or U.S. Pat. No. 4,388,913. The electrical servomotor 5 is controlled by an electronic control device 10 as a function of the operating parameters of the internal combustion engine such that at 11, for example, the electronic control device is supplied with a signal relating to the speed of the engine as detected from a known ignition distributor, at 12 with a signal relating to engine temperature and at 13 with a signal relating to the position of the throttle valve 2 as supplied, for example, by a potentiometer connected to the throttle valve 2.

The throttle unit 6 comprises a throttle housing 16 comprising a cylindrical housing part 17 and a flange 18 projecting radially above this cylindrical housing part 17. The throttle housing 16 contains a turning space 19 transversely crossing the cylindrical housing part and ending on the surface of the cylindrical housing part 17 in an inlet opening 20 and an outlet opening 21 At right angles to the turning space 19 and concentrically with respect to the cylindrical housing part 17, the throttle housing 16 is crossed by a shaft 24 which projects into the servomotor 5 by which it is rotatable in a known manner. The shaft 24 is mounted by way of a lower ball bearing 25 is pressed into a retaining orifice 27 on the opposite end of the housing part 17 to the flange 18 and the upper ball bearing 16 is pressed into a retaining orifice 28 in the flange 18. The shaft 24 can obviously also be mounted in a conventional manner by means of friction bearings. The shaft 24 passes from the retaining opening 28 to the turning space 19 via an upper opening of passage 29 and from the turning space 19 to the retaining opening 27 via a lower opening of passage 30. The upper opening of passage 29 and the lower opening of passage 30 offer minimal play with respect to the shaft 24 to prevent dust particles from passing from the turning space 19 to the ball bearings 25, 26., The upper ball bearing 26 is acted on by a tension spring, more specifically, a cup spring 33, which exerts initial stress on the shaft 24 in an axial direction thereby preventing axial bearing play. The cup spring is supported on its opposite side to the bearing 26 by an intermediate plate 34 which is retained by a retaining ring 35 snapped onto the shaft 24.

In the present embodiment, the turning space 19 is shown as the channel with a cylindrical cross-section passing through the cylindrical housing part 127 and extending at right angles to the shaft 24. In the embodiment shown in FIG. 1, a throttle member 36, for example, a throttle valve is disposed in the turning space 19 and rigidly connected to the shaft 24, for example, by means of a screw 37. The turning space 19 is generally of limited diameter and, in its starting position in which it closes the turning space, the throttle member 36 must be precisely centered to eliminate the flow of medium and to prevent air leakage at the periphery of the throttle member 36. In the embodiment of the throttle unit 6, according to the invention, the centering of the throttle member 36 in the turning space 19 can be readily accomplished via the inlet opening 10 or the outlet opening 21 and the screw 37 is then tightened to secure the throttle member 36 in the centered position which has been determined. Departing from the starting position in which the cross-section of the turning space 19 is completely closed, the maximum quantity of air flowing across the turning space 19 is obtained when the throttle member 36 is turned by the servomotor 5 via the shaft 24 into a position parallel to the flow direction.

The regulating device 4 also comprises the holder 7 which can include the very wall of the air intake line 1, or, for example, of the wall of the engine block of the internal combustion engine. For this purpose, there is provided in the wall of the air intake line 1 or engine block a flow channel 40 which forms part of the by-pass line 3. Intersecting the flow channel 40, a cylindrical receiving orifice 41 extends from the surface of the wall of the air intake line 1 or engine block into the interior of the wall. The cross-section of the receiving orifice 41 is such that the cylindrical housing part 17 of the throttle unit 6 can be inserted into the receiving orifice in such a way that the inlet opening 20 is in flow connection with the upstream end of the flow channel 40 at the receiving opening 41 and the outlet opening 21 is in flow connection with the downstream beginning of the flow channel 40 at the wall of the receiving opening 41. Accordingly, when the throttle unit 6 is inserted in the receiving opening 41, the throttle member 36 controls the airflow via the flow channel 40 and hence the airflow via the by-pass line 3. When the throttle unit 6 is inserted in the receiving opening 41 the flange 18 of the throttle unit 6 rests on the outer wall of the holder 7 and is secured to the holder 7, for example, by means of a screw connection 42. The shape of the flange is determined by the form of the servomotor 5 and the surface conditions of the holder 7. For sealing purposes there is provided in the wall of the holder 7 between the flow channel 40 and the surface of the holder 7 directed toward the flange 18, a sealing groove 43 which is open in the direction of the receiving opening 41 and which has a sealing ring 44 inserted therein. Another sealing groove 45 which is open in the direction of the receiving opening 41 and in which is inserted a sealing ring 47 is provided in the wall of the holder 15 7 between the flow channel 40 and the bottom 46 of the receiving opening 41. The cylindrical housing part 17 has a minimum of play with respect to the diameter of the receiving opening 41 to prevent air leakage at the periphery of the cylindrical housing part 17.

Any throttle unit, even one differing from the throttle unit 7 shown in FIG. 1 can be inserted in the receiving opening 41 of the holder 7 as long as the diameter of its cylindrical housing 17 corresponds to the diameter of the receiving opening 41. Accordingly, the throttle member 36 may have the shape shown in FIGS. 4 and 5 and the cross-section of the turning space, respectively, of the inlet opening 20 and outlet opening 21 may be smaller or larger than the cross section of the flow channel 40.

Figure 3:
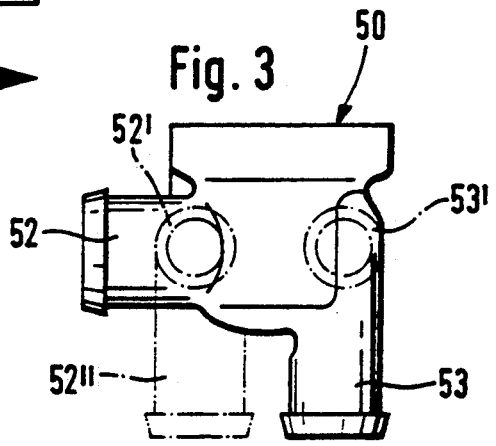
FIG. 3 shows different configurations of a holder for the regulator according to the invention.
Figure 2:
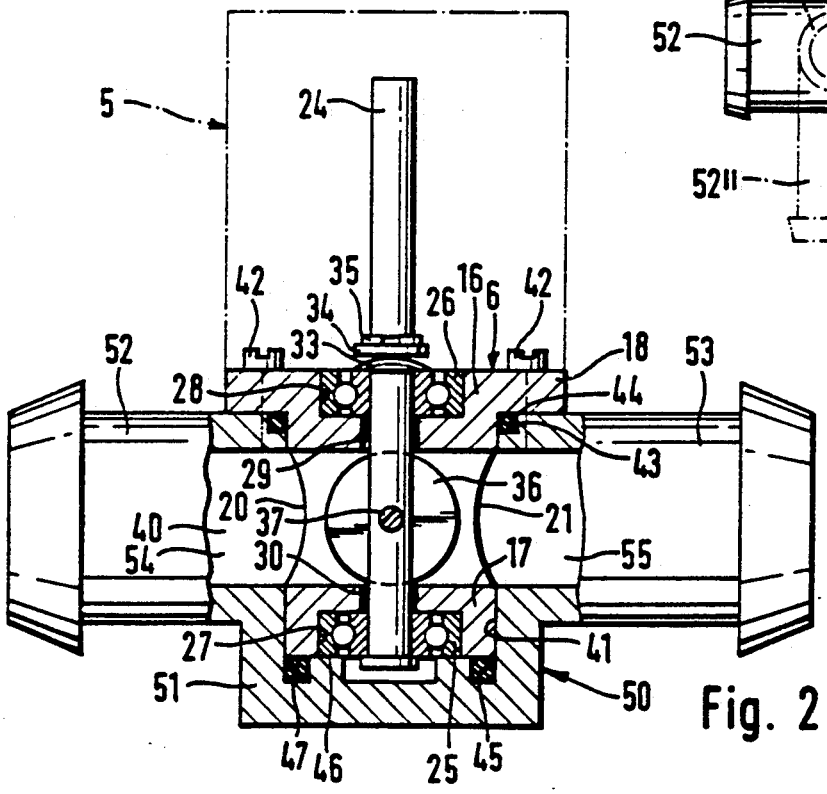
FIG. 2 shows partial cross sectional view of a second embodiment of a regulator according to the invention.

In the second embodiment of the invention shown in FIG. 2 the same parts as those shown in FIG. 1 are designated by the same reference numbers. The servomotor 5 and the throttle unit 6 correspond to those in FIG. 1. In contrast to the embodiment shown in FIG. 1, the holder 50 includes a single unit having an essentially cup-shaped main part 51 with a receiving opening 41 provided therein. The main part 51 incorporates an inflow connector 52 and an outflow connector 53. The inflow connector 52 and outflow connector 53 can be in alignment with one another as shown in FIG. 2. The parts 52 and 53 contain the flow channel which, as in FIG. 1, comprises an inflow portion 54 upstream of the receiving opening 41 and an outflow portion 55 disposed downstream of the receiving opening 41. Accordingly, the inflow portion 54 ends at the wall or the receiving opening 41 and the outflow portion of the channel 40 begins at the wall of the receiving opening 41. The holder 50 shown in FIG. 2 can be easily replaced by a differently-shaped holder having a different shape or having a differently positioned inflow connector 52 and outflow connector 53. Accordingly, FIG. 3 shows or indicates different embodiments of the holder 50 shown in FIG. 2. When the inflow connector 52 is disposed at right angles to the receiving opening 41 the outflow connector 53 may not only be arranged at right angels to and parallel to the receiving opening so that it is downwardly directed but it may also be at right angles to and in the same plane as the inflow connector 52 as shown at 53' by the perforated lines. Similarly, the inflow connector 52 can be disposed at right angles to the drawing plane as shown by the perforated lines at 52' or it may be downwardly directed according to the drawing plane as shown at 52" such that the inflow and outflow connectors are parallel to one another.

In the embodiments shown in FIGS. 4, 5 and 6 only the throttle unit 6 is shown and not the servomotor 5 and holder 7 respectively, which are shown and described in the preceding figures and which are also employed with the embodiments shown in FIGS. 4, 5 and 6. The same reference numbers are used in the embodiment shown in FIGS. 4, 5 and 6 to designate the same parts or parts having the same function as those described in the preceding embodiments. Accordingly, in the throttle housing 16 of the throttle unit 6, the shaft 24 is mounted via the ball bearings a 25 and 26, crosses the turning space 19 which has a circular cross-section and extends concentrically with respect to the cylindrical housing part 17 and at the opposite end 58 of the cylindrical housing part to the flange 18 is limited by a plate 59 which is inserted in a step opening 60 and which comprises the retaining opening 27 for the lower ball bearing 25. Between the turning space 19 and the surface of the cylindrical housing part 17 is a tubular wall which is interrupted by a control window 61 and at a distance from the latter by a control window 62. The control windows 61 and 62 may be basically any shape. When the throttle unit 6 is inserted in the receiving opening of a holder the windows are in flow connection with the appropriate flow channel 40. The control window 61 advantageously has a generally rectangular cross-section and its longer side wall which serves as a control face 63 extends parallel to the shaft 24. The flow direction of the air flowing via the flow channel can be such that the control window 61 forms either an intake opening or an outlet for the throttle unit 6. The control window 61 preferably forms the intake opening. The cross-section of the control window is preferably such that when the control window 61 is fully open the maximum amount of air can flow in.

In this embodiment the throttle member consists of a rotary slide valve 66 which is, for example, U-shaped and has a lower attachment part 67 and an upper attachment part 68 forming the arms of the U-shape. Each attachment part 67, 68 embraces the shaft 24 and is rigidly connected to the same. A spacing bushing 69 can be mounted on the shaft 24 between the attachment parts 67, 68. In the opposite direction to the shaft the attachment parts 67, 68 are connected to a control part 72 which has a circular periphery directed toward the wall of the turning space 19; said periphery having a diameter which is only very slightly smaller than that of the turning space 19 to ensure that air leakages are kept to a minimum. The control part 72 can be a similar shape to the annular part 73 shown in FIG. 5. A control surface 74 of the control part 72 extending generally parallel to the shaft 24 opens the control window 61 to a greater or lesser extent and provides a controlled flow cross-section for the air flow in respect of the control face 63.

Accordingly, the invention allows for the individual production of the servomotor 5, the throttle unit 6 and the holder 7 so that these individual units can subsequently be combined together in a suitable form for a particular application.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A regulator for controlling an operating medium for an internal combustion engine comprising a throttle housing (16), a throttle unit in said throttle housing, a shaft mounted in a turning space and extending from said throttle housing (16), a throttle member (36) connected to said shaft in said turning space; and regulator serving to control the flow of a medium from an inlet opening (20) via the turning space to an outlet opening (21) provided in the throttle housing, the throttle housing (16) comprises a cylindrical housing part (17) which is insertable in a tight manner in a receiving opening (41) of a holder (7, 50) having incorporated in said holder a flow channel (40) for conveying the flow medium; said flow channel (40) being divided by the throttle housing (16) into an inflow portion (54) and an outflow portion (55) such that at a wall of the throttle housing (16) the inflow portion (54) is connected to the inlet opening (20) in the throttle housing (16) and the outflow portion (55) is connected at the wall of the throttle housing (16) to the outlet opening (21) in the throttle housing (16).

2. A regulator as claimed in claim 1, in which an air intake line (1) of internal combustion engine serves as the holder (7) and the receiving opening (41) and the flow channel (40) are built into the wall of the air intake line (1).

3. A regulator as claimed in claim 1, in which an engine block of an internal combustion engine serves as the holder (7) and the receiving opening (41) and the flow channel (40) are built into the wall of the engine block.

4. A regulator as claimed in claim 1, in which the holder (50) comprises an inflow connector (52) incorporating the inflow portion (54) of the flow channel (40) and an outflow connector (53) incorporating the outflow portion (55) of the flow channel (40).

5. A regulator as claimed in claim 1, in which the inflow connector (52) and the outflow connector (53) are in alignment with one another.

6. A regulator as claimed in claim 1, in which the inflow connector (52) and outflow connector (53) are at an angle to one another.

7. A regulator as claimed in claim 1, in which the inflow connector (52) and outflow connector (53) are parallel to one another.

8. A regulator as claimed in claim 1, in which a throttle valve serves as the throttle member (36).

9. A regulator as claimed in claim 1, in which the throttle member (36) consists of a rotary slide valve comprising an attachment part (67, 68) connected to the shaft (24) and a control part (72).

10. A regulator as claimed in claim 9, in which the control part (72) is in the form of an annular segment (73).

11. A regulator as claimed in claim 9, in which the control part (72) opens to a greater or lesser extent a control window (61) in the wall of the cylindrical housing (17) of the throttle housing (16).

12. A regulator as claimed in claim 10, in which the control part (72) opens to a greater or lesser extent a control window (61) in the wall of the cylindrical housing (17) of the throttle housing (16).

13. A regulator as claimed in claim 11, in which the control window (61) serves as the inlet opening.

14. A regulator as claimed in claim 12, in which the control window (61) serves as the inlet opening.

15. A regulator as claimed in claim 11, in which the control window (61) serves as an outlet opening (61).

16. A regulator as claimed in claim 12, in which the control window (61) serves as an outlet opening (61).

17. A regulator as claimed in claim 11, in which the control window (61) is essentially rectangular in shape.

18. A regulator as claimed in claim 12, in which the control window (61) is essentially rectangular in shape.

19. A regulator as claimed in claim 1, in which the throttle housing (16) comprises a flange (18) which can be placed on the holder (7, 50) and attached thereto.

20. A regulator as claimed in claim 12, in which the flow channel (40) forms a bypass line (3) around a throttle valve (2) in an air intake line (1) of an internal combustion engine.

21. A regulator as set forth in claim 1 in which said throttle housing and throttle unit are insertable into said holder as a single unit.

* * * * *